US007506904B2

(12) United States Patent
Hall

(10) Patent No.: US 7,506,904 B2
(45) Date of Patent: Mar. 24, 2009

(54) DOOR HANDLE LOCK ASSEMBLY WITH AUTOMATIC LOCK AND RETRACT

(75) Inventor: George M. Hall, Avalon, TX (US)

(73) Assignee: Bell Helicopter Textron Inc., Hurst, TX (US)

( * ) Notice: Subject to any disclaimer, the term of this patent is extended or adjusted under 35 U.S.C. 154(b) by 160 days.

(21) Appl. No.: 11/319,412

(22) Filed: Dec. 29, 2005

(65) Prior Publication Data

US 2007/0170730 A1 Jul. 26, 2007

(51) Int. Cl.
*E05B 3/00* (2006.01)

(52) U.S. Cl. ..... 292/336.3; 292/DIG. 31; 244/129.4

(58) Field of Classification Search ..... 292/336.3, 292/DIG. 31; 70/208; 244/129.4, 129.5
See application file for complete search history.

(56) References Cited

U.S. PATENT DOCUMENTS

| | | | | | |
|---|---|---|---|---|---|
| 2,239,301 | A | * | 4/1941 | Papst | 292/1 |
| 2,260,785 | A | * | 10/1941 | Miguel | 70/208 |
| 2,349,192 | A | | 5/1944 | Oxhandler | |
| 2,375,196 | A | * | 5/1945 | Cederwall | 70/118 |
| 2,377,301 | A | | 5/1945 | Rolph | |
| 2,486,586 | A | | 11/1949 | Brittain et al. | |
| 2,622,430 | A | | 12/1952 | Adams et al. | |
| 2,833,582 | A | * | 5/1958 | Henrichs | 292/336.3 |
| 3,050,790 | A | | 8/1962 | Wakefield | |
| 3,735,613 | A | | 5/1973 | Diebel et al. | |
| 3,745,796 | A | | 7/1973 | Fleming | |
| 4,487,440 | A | * | 12/1984 | Beijer | 292/336.3 |
| 4,898,408 | A | * | 2/1990 | Hauber | 292/7 |
| 5,156,359 | A | * | 10/1992 | Noble et al. | 244/129.4 |
| 5,526,660 | A | | 6/1996 | Bennett et al. | |
| 6,059,231 | A | * | 5/2000 | Dessenberger, Jr. | 244/129.5 |
| 6,095,573 | A | * | 8/2000 | Rozema | 292/51 |
| 6,623,052 | B2 | | 9/2003 | Hansen | |

FOREIGN PATENT DOCUMENTS

| | | |
|---|---|---|
| AT | 303 565 | 11/1972 |
| DE | 254 340 | 11/1912 |
| DE | 373 259 | 4/1923 |
| DE | 8614642 | 7/1986 |
| EP | 1 544 383 | 6/2005 |

OTHER PUBLICATIONS

Notification of Transmittal of International Search Report and Written Opinion, International Search Report, and Written Opinion of the International Search Authority issued in PCT/US2006/062481, dated Oct. 30, 2008, 13 pages.

* cited by examiner

*Primary Examiner*—Gary Estremsky
(74) *Attorney, Agent, or Firm*—Pillsbury Winthrop Shaw Pittman LLP

(57) ABSTRACT

A door handle lock assembly includes a housing configured to be attached to a door. A interconnecting member is rotatably and axially movably supported by the housing. A first handle is fixed to the interconnecting member at a first end of the interconnecting member and a second handle is fixed to the interconnecting member at a second end of the interconnecting member. The door is between the second handle and the housing. The door handle lock assembly is changed from a locked condition to an unlocked condition by axially moving the interconnecting member from a first position to a second position and then rotating the interconnecting member.

22 Claims, 8 Drawing Sheets

DOOR HANDLE LOCK ASSEMBLY WITH AUTOMATIC LOCK AND RETRACT

BACKGROUND OF THE INVENTION

1. Field of the Invention

The present invention relates to a door handle lock assembly, and more particularly, to a door handle lock assembly for a door of an aircraft.

2. Description of the Related Art

Door handle lock assemblies for aircraft doors generally include a handle on the outside of the door that is configured to be flush with an outer surface of the aircraft when the aircraft is in flight. The outside handle is flush with the outer surface to prevent or reduce drag on the outer surface of the aircraft. Current door handle lock assemblies include handles that may be pivoted from a position flush with the outer surface to a position where the outside handle may be operated to open the door. Other current door handle lock assemblies include handles that may be moved into and out of the flush position by operation of a mechanism, for example a cam mechanism or a spring loaded mechanism.

One problem with current door handle lock assemblies for aircraft doors is that although the outside handle may be in the flush position, the door may not be latched or locked. Another problem is that there is no positive lock on the door to prevent the door from being opened accidentally without a second operation of the inside handle. An even further problem with current aircraft door handle lock assemblies is they are complicated and not easily operated.

SUMMARY OF THE INVENTION

A door handle lock assembly according to the present invention includes a housing configured to be attached to a door. A interconnecting member is rotatably and axially movably supported by the housing. A first handle is fixed to the interconnecting member at a first end of the interconnecting member and a second handle is fixed to the interconnecting member at a second end of the interconnecting member. The door is between the second handle and the housing. The door handle lock assembly is changed from a locked condition to an unlocked condition by axially moving the interconnecting member from a first position to a second position and then rotating the interconnecting member.

BRIEF DESCRIPTION OF THE DRAWINGS

Embodiments of the present invention will be described below with references to the following drawings, in which corresponding reference numbers depict corresponding features throughout the figures, and wherein.

DETAILED DESCRIPTION

Figure 1:
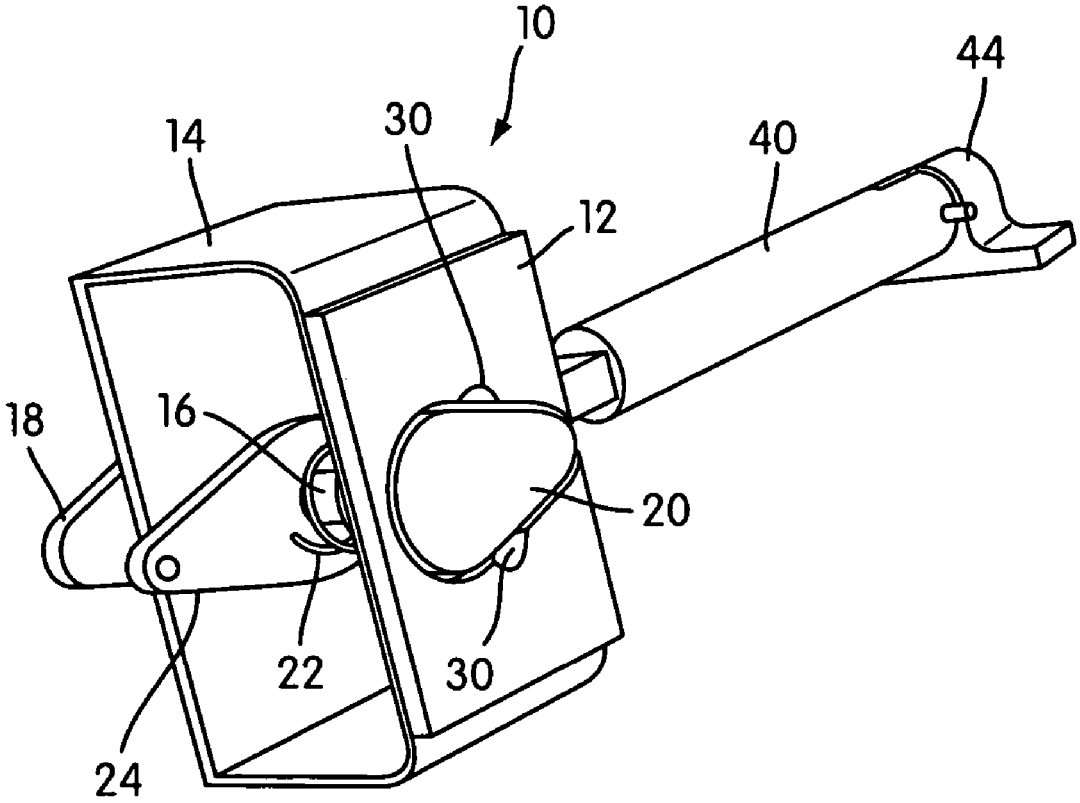
FIG. 1 is a schematic perspective view of a door handle lock assembly according the present invention in a locked position.
Figure 2:
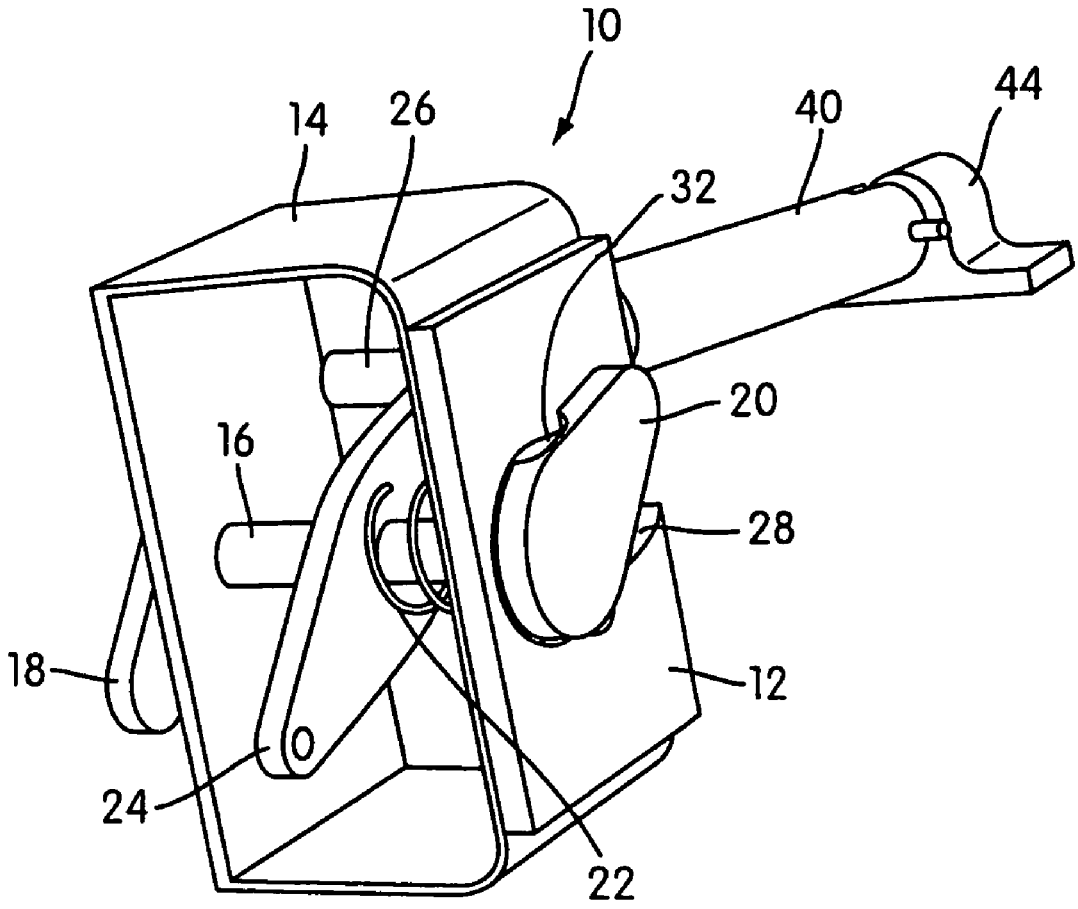
FIG. 2 is a schematic perspective view of the door handle lock assembly in an unlocked position.

Referring to FIGS. 1 and 2, a door handle lock assembly 10 according to the invention is mounted to a door 12 of an aircraft. The door 12 of the aircraft is only partially shown in the figures for clarity. The assembly 10 further includes a housing 14 that supports a handle assembly. The handle assembly includes a interconnecting member 16 that is rotatably supported by the housing 14. The interconnecting member 16 is also supported by the housing 14 so as to be translatable in a direction defined by the longitudinal axis of the interconnecting member 16. The interconnecting member 16 may be a shaft. It should be appreciated that the shaft may be formed from a unitary piece, or may be a plurality of pieces that are connected.

An inner handle 18 is fixed to the interconnecting member 16 at a first side of the housing 14. When the door is closed, the inner handle 18 will be accessible from the interior of the aircraft. An outer handle 20 is also fixed to the interconnecting member 16 at a second side of the housing 14. The outer handle 20 will be accessible from the exterior of the aircraft when the door is closed. A locking member 24 is fixed to the interconnecting member 16 for rotation and translation with the interconnecting member 16. A spring 22 is disposed between the locking member 24 and the housing 14 to bias the assembly 10 into the locked position shown in FIG. 1. As shown in FIG. 1, when the assembly is in the locked position, the outer handle 20 is received in a recess 28 in the door 12. The recess 28 has a shape that is complementary to the shape of the outer handle 20 so that when the outer handle 20 is received in the recess 28, the outer handle 20 is flush with the exterior surface of the door 12.

The recess 28 includes additional recesses 30 on opposite sides of the outer handle 20 that permit an operator on the exterior side of the door to grip the outer handle 20 when the outer handle is in the locked position. The operator can grip the outer handle 20 and pull the outer handle against the bias of the spring 22 to begin to unlock the assembly 10. The outer handle 20 may include an undercut portion 32, or portions, to improve the operator's ability to grip the outer handle 20. Once the operator has pulled the outer handle 20 out of the recess 28, the operator can rotate the outer handle 20 to complete the unlocking procedure. An operator on the interior side of the door can unlock the assembly 10 by first pushing on the inner handle 18 against the bias of the spring 22 so that the outer handle 20 is moved out of the recess 28 in the door. The operator can then rotate the inner handle 18 from the position shown in FIG. 1 to the position shown in FIG. 2.

Figure 3:
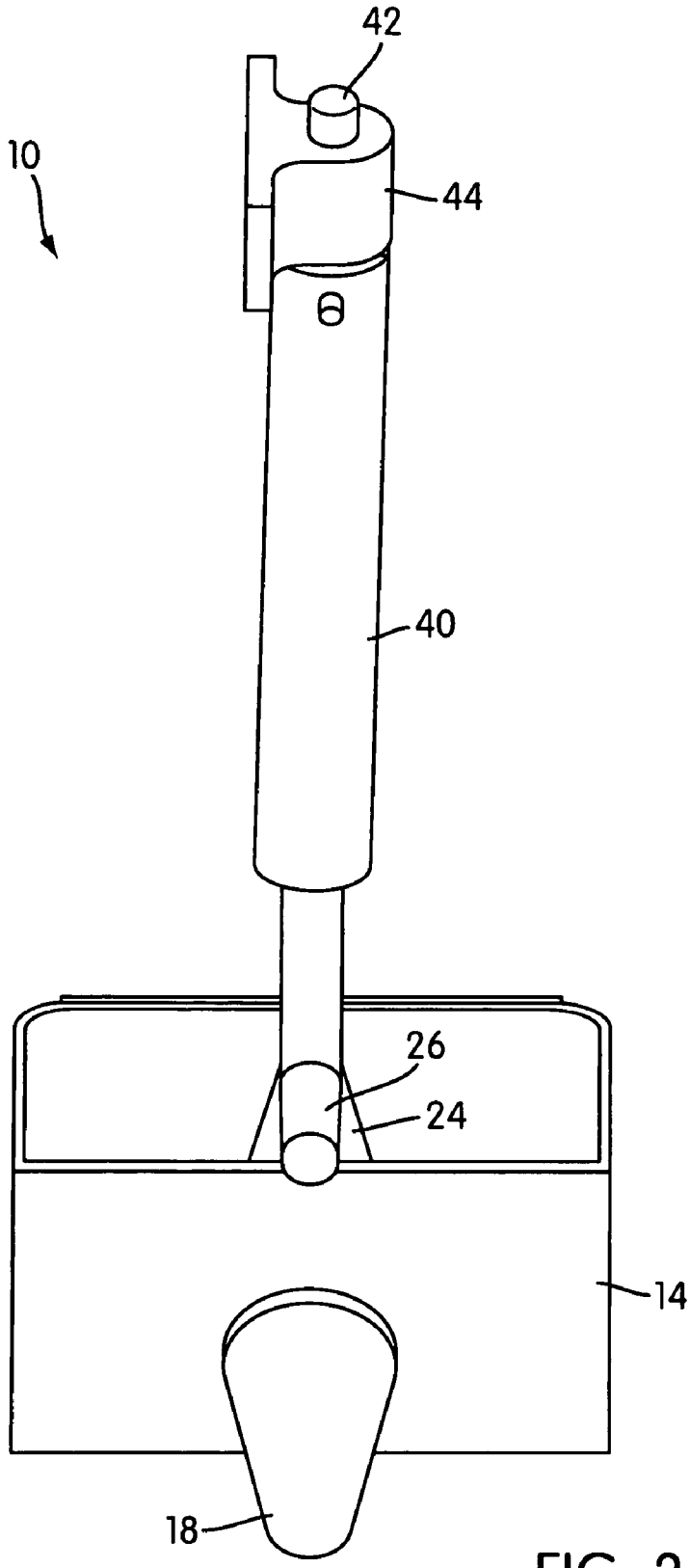
FIG. 3 is a perspective side view of the door handle lock assembly in the locked position.
Figure 4:
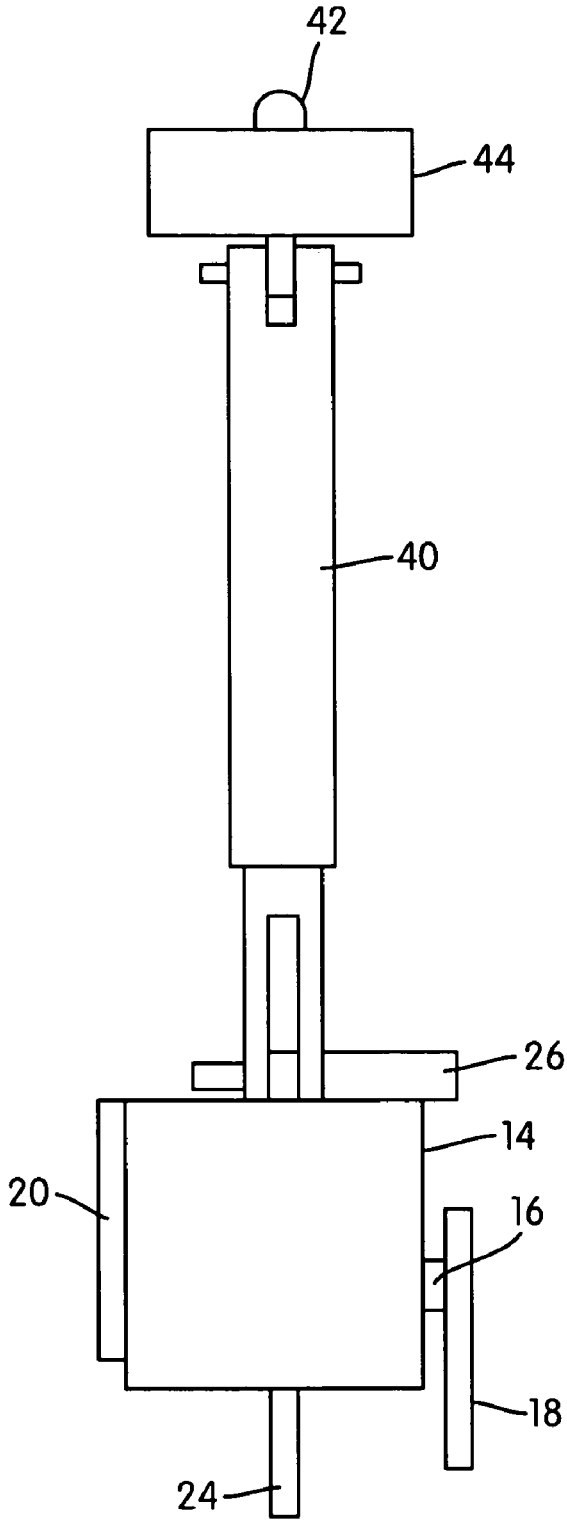
FIG. 4 is a side elevation view of the door handle lock assembly in the locked position.
Figure 5:
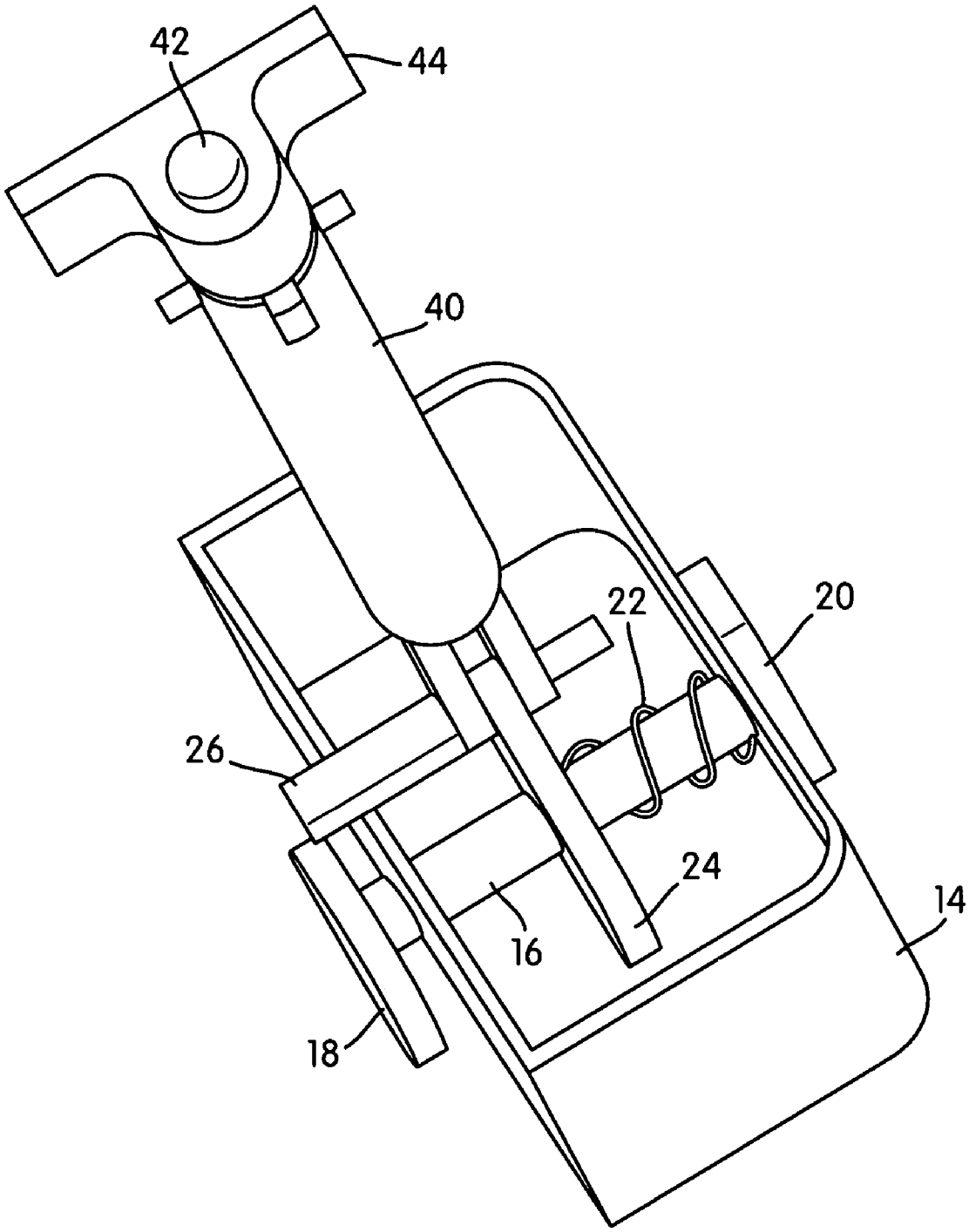
FIG. 5 is a perspective top view of the door handle lock assembly in the locked position.
Figure 6:
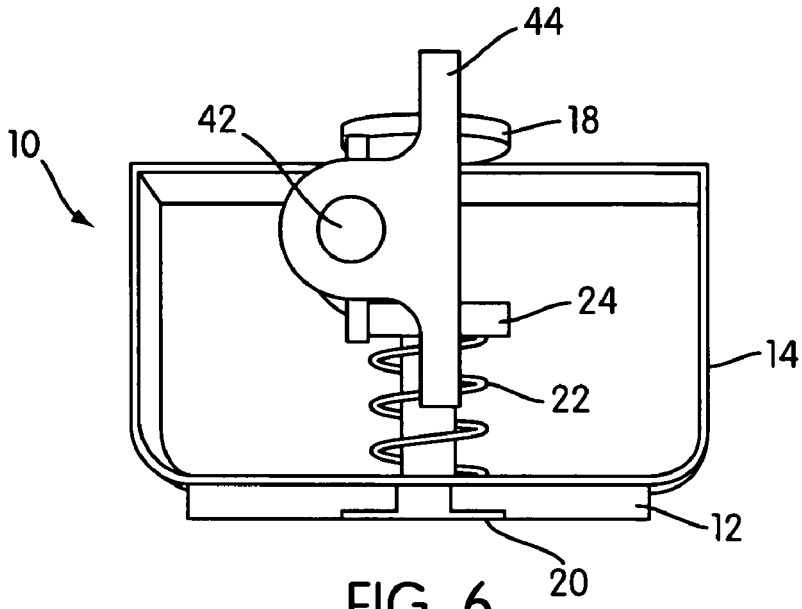
FIG. 6 is a top plan view of the door handle lock assembly in the locked position.
Figure 7:
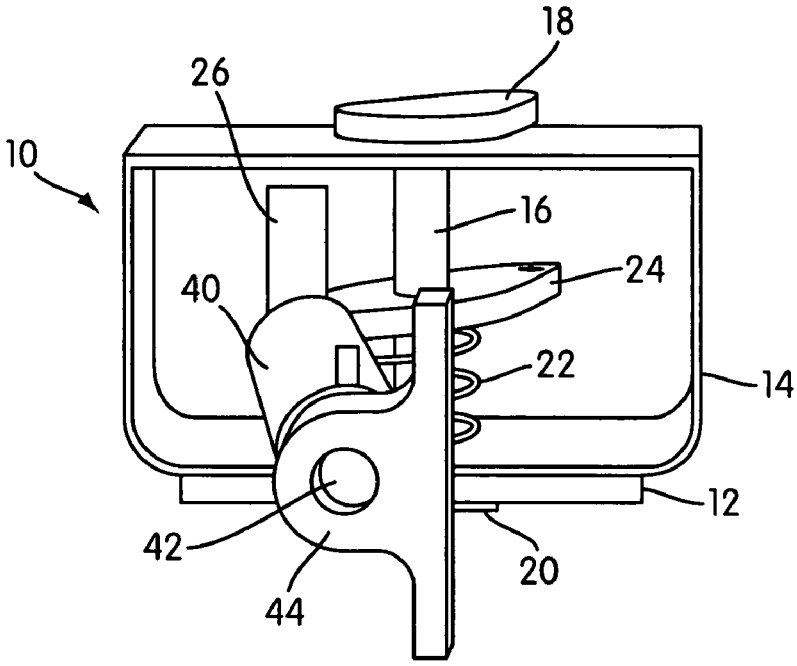
FIG. 7 is a top plan view of the door handle lock assembly in the unlocked position.

Referring to FIGS. 3-7, when the assembly is in the locked position, a locking projection 26, which is fixed to the locking member 24, is in engagement with the housing 14, as shown in FIGS. 3-5, to prevent rotation of the interconnecting member 16, and thus prevent rotation of the inner handle 18 and the outer handle 20. The operator begins the unlocking procedure by moving the interconnecting member 16 and the locking member 24 against the bias of the spring 22. If the operator is inside the aircraft, the operator pushes on the inner handle 18 to move the interconnecting member 16 and the locking member 24 against the bias of the spring 22. If the operator is outside the aircraft, the operator grasps the outer handle 20 and pulls against the bias of the spring 22. When the locking member 24 is moved from the position shown in FIGS. 3-5 to the position shown in FIG. 7, the locking projection 26 is disengaged from the housing, and then the interconnecting member 16 may be rotated by rotation of either inner handle 18 or outer handle 20.

Figure 8:
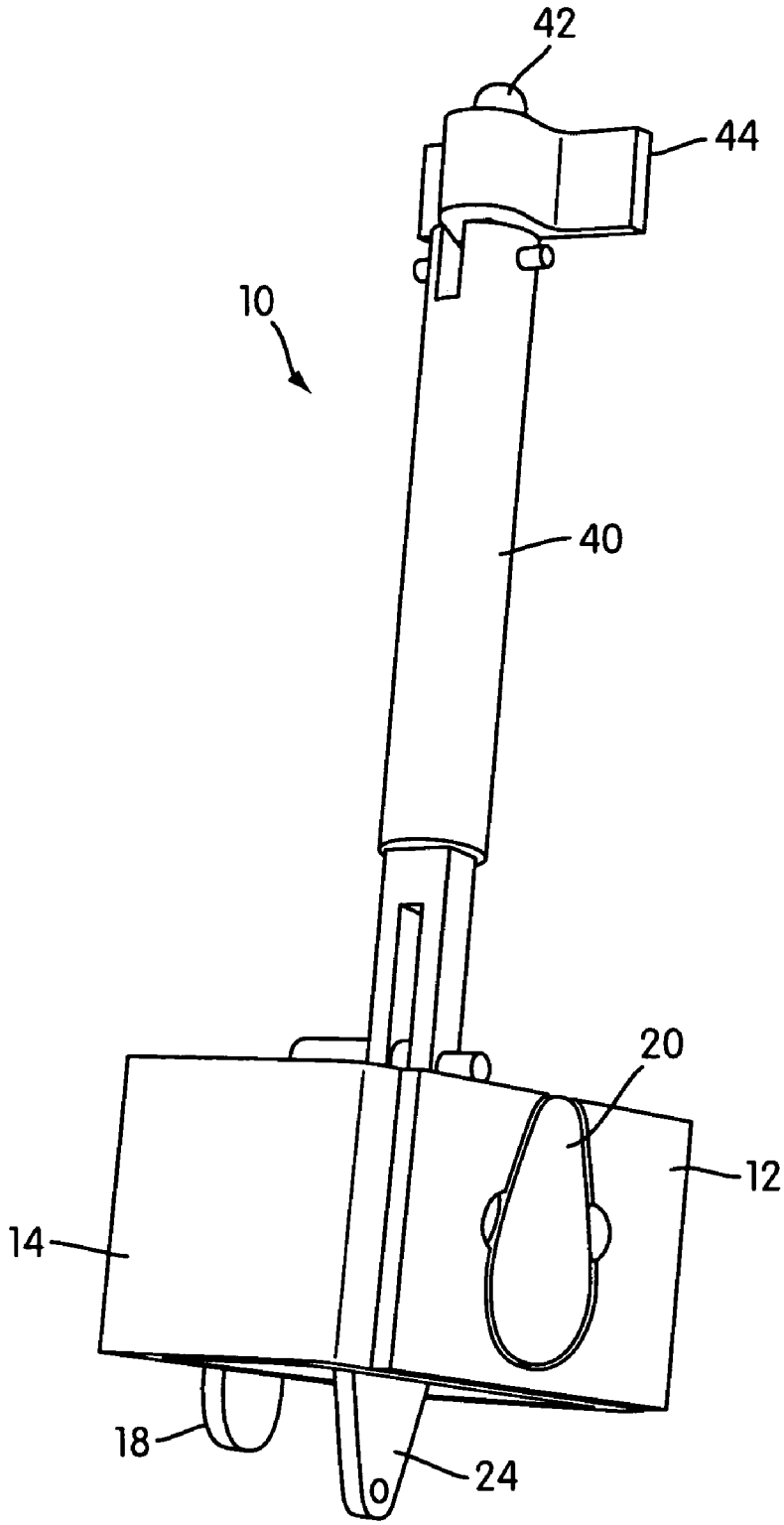
FIG. 8 is a perspective view of the door handle lock assembly in the locked position.
Figure 9:
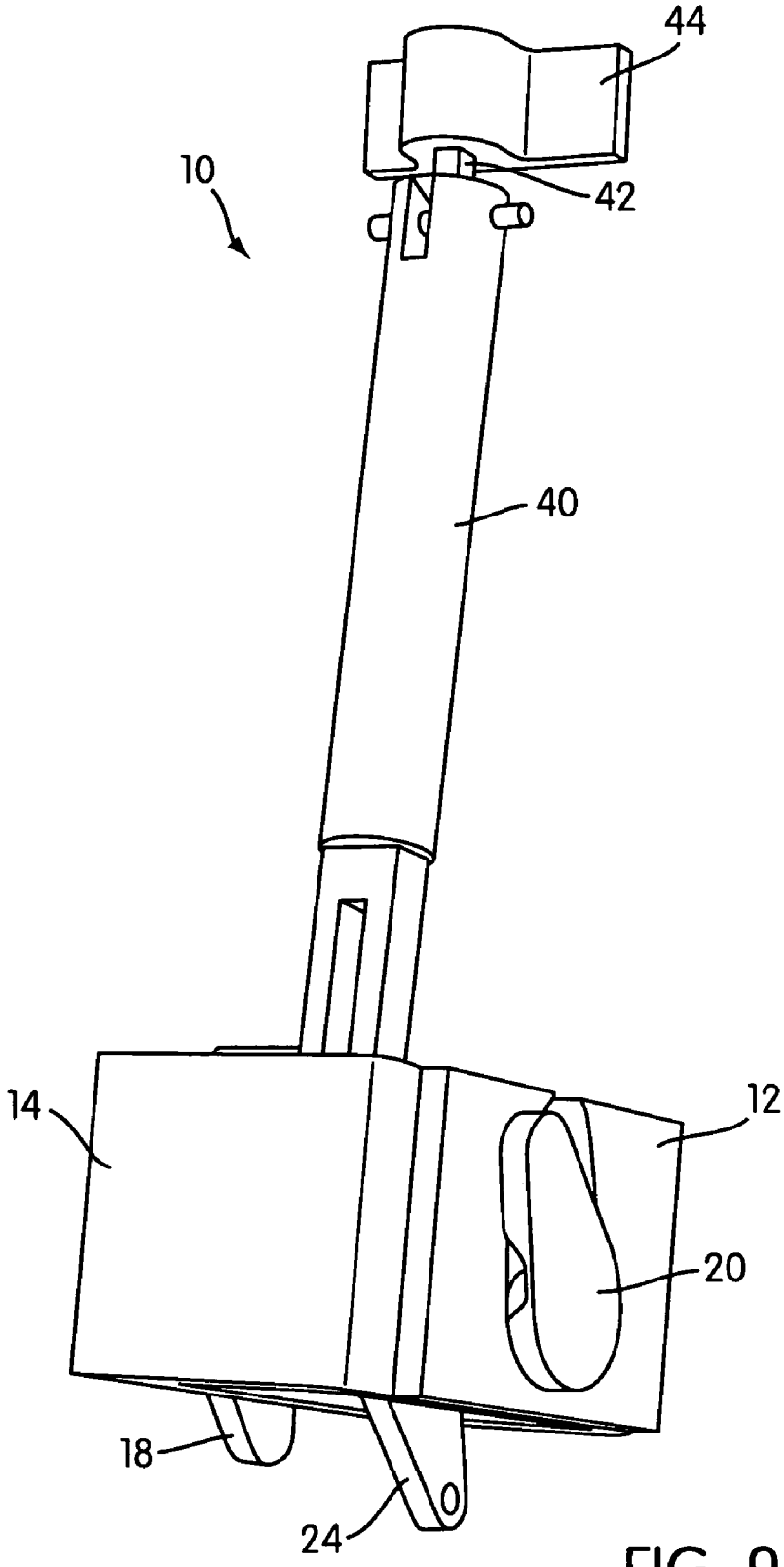
FIG. 9 is a perspective view of the door handle lock assembly prior to entering the unlocked position.

A locking bolt 40 is pivotally connected to the locking member 24 by the locking projection 26 at a first end of the locking bolt 40. It should be appreciated that the locking bolt may be pivotally connected to the locking member at a position other than the locking projection. A locking pin 42 is pivotally connected to the locking bolt 40 at a second end of the locking bolt 40. The locking pin 42 is received in a locking flange 44 that is positioned on the periphery of the doorway. When the locking pin 42 is received in the locking flange 44, the door 12 is locked. When the locking projection 26 is disengaged from the housing 14, either by pushing the inner handle 18 or pulling the outer handle 20, and the locking member 24 is rotated, the locking bolt 40 is moved from the position in FIG. 8 to the position in FIG. 9. As shown in FIG. 9, the locking pin 42 is being withdrawn from the locking flange 44. Continued rotation of the handles 18 and 20 from the position shown in FIG. 9 will completely withdraw the locking pin 42 from the locking flange 44 and unlock the door 12.

Although one locking bolt 40 is shown attached to one end of the locking member 24 in FIGS. 1-9, it should be appreciated that a second locking bolt may be pivotally connected to the locking member 24 at the other end. It should also be appreciated that the locking member 24 may be shaped to have multiple, i.e. more than two, ends for the pivotal connection of multiple locking bolts. It should be further appreciated that although only one locking projection 26 is shown connected to the locking member 24, multiple locking projections may be connected to the locking member 24. It should be even further appreciated that although the locking bolt is shown pivotally connected to the locking pin which is received in the locking flange, the locking pin and or the locking flange are not required and the locking bolt may pass through an aperture in the door and an aperture in the frame defining the doorway to lock the door.

As shown in the figures, when the outer handle 20 is received in the recess 28 of the door 12, the door handle lock assembly is in the locked position. An operator on the outside of the aircraft can determine that the door is locked merely by confirming that the outer handle 20 is received in the recess 28. The door cannot be accidentally unlocked by pulling the outer handle 20 or pushing the inner handle 18. The door can only be unlocked by either pushing the inner handle or pulling the outer handle, and then rotating the handle to cause the locking bolts to move from the locked position to the unlocked position. When the assembly is in the unlocked position and it is desired to place the assembly in the locked position, inner handle 18 or the outer handle 20 is rotated and the bias of the spring 22 automatically retracts the handles 18 and 20 to their locked positions.

Although the present invention has been described with references to the embodiments disclosed herein, it should be appreciated that numerous variations and modifications may be made without departing from the spirit and scope of the present invention.

What is claimed is:

1. A door handle lock assembly, comprising:

a housing configured to be attached to a door;

an interconnecting member rotatably and axially movably supported by the housing;

a first handle fixed to the interconnecting member at a first end of the interconnecting member;

a second handle fixed to the interconnecting member at a second end of the interconnecting member, wherein the door is between the second handle and the housing, the door handle lock assembly is changed from a locked condition to an unlocked condition by axially moving the interconnecting member from a first position to a second position and then rotating the interconnecting member, and the first and second handles axially move in unison during axial movement of the interconnecting member from the first position to the second position, and a lock member fixed to the interconnecting member between the first handle and the second handle, the lock member configured to engage the housing to prevent rotation of the interconnecting member when the interconnecting member is in the first position and to disengage from the housing when the interconnecting member is moved from the first position to the second position to permit rotation of the interconnecting member.

2. A door handle lock assembly according to claim 1, further comprising:

a spring between the lock member and the housing that biases the interconnecting member into the first position.

3. A door handle lock assembly according to claim 1, wherein the second handle is configured to be received in a recess in the door when the interconnecting member is in the first position.

4. A door handle lock assembly according to claim 3, wherein the recess comprises a first recess having a shape complementary to the shape of the second handle.

5. A door handle lock assembly according to claim 4, wherein the recess further comprises a second recess and/or the second handle includes a recess.

6. A door handle lock assembly according to claim 3, wherein the second handle is configured to be flush with an outer surface of the door when the interconnecting member is in the first position.

7. A door handle lock assembly according to claim 1, wherein the interconnecting member is a shaft.

8. A door handle lock assembly, comprising:

a housing configured to be attached to a door;

an interconnecting member rotatably and axially movably supported by the housing;

a first handle fixed to the interconnecting member at a first end of the interconnecting member;

a second handle fixed to the interconnecting member at a second end of the interconnecting member, wherein the door is between the second handle and the housing, and the door handle lock assembly is changed from a locked condition to an unlocked condition by axially moving the interconnecting member from a first position to a second position and then rotating the interconnecting member;

a lock member fixed to the interconnecting member between the first handle and the second handle; and a spring between the lock member and the housing that biases the interconnecting member into the first position, wherein the lock member includes a locking projection that engages the housing to prevent rotation of the interconnecting member when the interconnecting member is in the first position and is disengaged from the housing when the interconnecting member is moved from the first position to the second position to permit rotation of the interconnecting member.

9. A door handle lock assembly according to claim 8, further comprising a locking bolt pivotally connected to the locking member.

10. A door handle lock assembly according to claim 9, wherein the locking bolt is pivotally connected to the locking member by the locking projection.

11. A door handle lock assembly according to claim 10, further comprising a locking pin pivotally connected to an end of the locking bolt opposite an end at which the locking bolt is pivotally connected to the locking member.

12. An aircraft including a door and a door handle lock assembly, the door handle lock assembly comprising:

a housing configured to be attached to the door;

a interconnecting member rotatably and axially movably supported by the housing;

a first handle fixed to the interconnecting member at a first end of the interconnecting member a second handle fixed to the interconnecting member at a second end of the interconnecting member, wherein the door is between the second handle and the housing, the door handle lock assembly is changed from a locked condition to an unlocked condition by axially moving the interconnecting member from a first position to a second position and then rotating the interconnecting member, and the first and second handles axially move in unison during axial movement of the interconnecting member from the first position to the second position, and a lock member fixed to the interconnecting member between the first handle and the second handle, the lock member configured to engage the housing to prevent rotation of the interconnecting member when the interconnecting member is in the first position and to disengage from the housing when the interconnecting member is moved from the first position to the second position to permit rotation of the interconnecting member.

13. An aircraft according to claim 12, further comprising:

a spring between the lock member and the housing that biases the interconnecting member into the first position.

14. An aircraft according to claim 12, wherein the second handle is configured to be received in a recess in the door when the interconnecting member is in the first position.

15. An aircraft according to claim 14, wherein the recess comprises a first recess having a shape complementary to the shape of the second handle.

16. An aircraft according to claim 15, wherein the recess further comprises a second recess and/or the second handle includes a recess.

17. An aircraft according to claim 14, wherein the second handle is configured to be flush with an outer surface of the door when the interconnecting member is in the first position.

18. An aircraft according to claim 12, wherein the interconnecting member is a shaft.

19. An aircraft comprising:

a door; and a door handle lock assembly comprising:

a housing configured to be attached to the door;

a interconnecting member rotatably and axially movably supported by the housing;

a first handle fixed to the interconnecting member at a first end of the interconnecting member;

a second handle fixed to the interconnecting member at a second end of the interconnecting member, wherein the door is between the second handle and the housing, the door handle lock assembly is changed from a locked condition to an unlocked condition by axially moving the interconnecting member from a first position to a second position and then rotating the interconnecting member;

a lock member fixed to the interconnecting member between the first handle and the second handle; and a spring between the lock member and the housing that biases the interconnecting member into the first position, wherein the lock member includes a locking projection that engages the housing to prevent rotation of the interconnecting member when the interconnecting member is in the first position and is disengaged from the housing when the interconnecting member is moved from the first position to the second position to permit rotation of the interconnecting member.

20. An aircraft according to claim 19, further comprising a locking bolt pivotally connected to the locking member.

21. An aircraft according to claim 20, wherein the locking bolt is pivotally connected to the locking member by the locking projection.

22. An aircraft according to claim 21, further comprising a locking pin pivotally connected to an end of the locking bolt opposite an end at which the locking bolt is pivotally connected to the locking member.

* * * * *